US009045244B2

(12) United States Patent
Griscik et al.

(10) Patent No.: US 9,045,244 B2
(45) Date of Patent: Jun. 2, 2015

(54) APPARATUS AND METHOD FOR STAINING A TOBACCO POUCH PRODUCT

(75) Inventors: Gregory J. Griscik, Midlothian, VA (US); Travis M. Garthaffner, Midlothian, VA (US)

(73) Assignee: ALTRIA CLIENT SERVICES INC., Richmond, VA (US)

( * ) Notice: Subject to any disclaimer, the term of this patent is extended or adjusted under 35 U.S.C. 154(b) by 970 days.

(21) Appl. No.: 13/102,892

(22) Filed: May 6, 2011

(65) Prior Publication Data

US 2012/0279178 A1 Nov. 8, 2012

(51) Int. Cl.

| | |
|---|---|
| ***B65B 31/00*** | (2006.01) |
| ***B65B 63/02*** | (2006.01) |
| ***B65B 5/06*** | (2006.01) |
| ***B65B 63/00*** | (2006.01) |
| ***B65B 29/00*** | (2006.01) |

(52) U.S. Cl.

CPC ..... *B65B 63/00* (2013.01); *B65B 29/00* (2013.01); *B65B 2220/14* (2013.01)

(58) Field of Classification Search

USPC ..... 131/347, 366–367, 352–358, 393; 53/111 R, 431, 437, 436, 525, 510, 432, 53/443; 8/149.1–149.3; 68/3, 200, 201

See application file for complete search history.

(56) References Cited

U.S. PATENT DOCUMENTS

| | | | |
|---|---|---|---|
| 4,528,993 | A | 7/1985 | Sensabaugh, Jr. et al. |
| 4,703,765 | A | 11/1987 | Paules et al. |
| 6,135,120 | A | 10/2000 | Lofman et al. |
| 2004/0025701 | A1 * | 2/2004 | Colston et al. ..... 99/279 |
| 2007/0012328 | A1 | 1/2007 | Winterson et al. |
| 2007/0031539 | A1 | 2/2007 | Calton, Jr. |
| 2007/0095356 | A1 | 5/2007 | Winterson et al. |
| 2007/0261707 | A1 | 11/2007 | Winterson et al. |
| 2008/0210249 | A1 | 9/2008 | Luzenberg |
| 2009/0035414 | A1 | 2/2009 | Cheng et al. |
| 2010/0018539 | A1 | 1/2010 | Brinkley et al. |
| 2010/0071711 | A1 | 3/2010 | Boldrini |
| 2010/0200005 | A1 | 8/2010 | Fallon |

FOREIGN PATENT DOCUMENTS

| | | | |
|---|---|---|---|
| WO | 2009/025604 | A1 | 2/2009 |

OTHER PUBLICATIONS

International Search Report from International Application No. PCT/US2012/036482.

* cited by examiner

*Primary Examiner* — Dennis Cordray

(74) *Attorney, Agent, or Firm* — Roberts Mlotkowski Safran & Cole, P.C.

(57) ABSTRACT

An apparatus for distributing moisture and staining the web of a plurality of tobacco sachets. The apparatus includes a turret wheel assembly comprising a rotatable turret wheel having a plurality of cups for receiving containers for tobacco sachets, a sensor for verifying the presence a container within a cup of the rotatable turret wheel, a hydraulic injector for injecting water into a container having a plurality of tobacco sachets, means for tamping tobacco sachets, and means for agitating and stirring the plurality of tobacco sachets to lift and stir tobacco sachets from the bottom of the container. A method of distributing moisture and staining the web of a plurality of tobacco sachets is also provided.

29 Claims, 3 Drawing Sheets

APPARATUS AND METHOD FOR STAINING A TOBACCO POUCH PRODUCT

FIELD

The present invention generally relates to pouched products, such as tobacco sachets, and methods and systems for their finishing and packaging. More particularly, the present invention relates to an apparatus, system and method of distributing moisture and staining the web of a plurality of tobacco sachets.

ENVIRONMENT

Tobacco sachets offer an individual portion of tobacco that is to be placed under the upper lip for tobacco enjoyment. In the production of tobacco sachets, it is desirable that the web of the tobacco sachets be evenly colored and wetted when handled by the consumer. This uniform color and homogeneous moisture level in each individual package or can is an important characteristic of the product appearing fresh and new. Typically, tobacco sachets are loaded into cans for distribution and sale at a high speed. As such, it would be desirable to provide an apparatus, system and method for finishing and packaging tobacco sachets that produces uniform color and homogeneous moisture level in the product.

SUMMARY

Provided is a method of distributing moisture and staining the web of a plurality of tobacco sachets. The method includes the steps of injecting water from a source of pressurized water into a container having a plurality of tobacco sachets, mechanically applying pressure to the plurality of tobacco sachets, and agitating and stirring the tobacco sachets using a pneumatic means for agitation and stirring, wherein water is distributed through the plurality of tobacco sachets to stain the web thereof as the water passes through the tobacco and into the web.

In one form, a turret wheel is used for receiving a plurality of containers and the method includes the step of loading a container for tobacco sachets into a first cup of a rotatable turret wheel of a turret wheel assembly, the container loading step conducted at a first station of the turret wheel assembly.

In another form, the method further includes the step of advancing the turret wheel to place a second cup at the first station of the turret wheel assembly and loading a second container into the second cup, the first cup simultaneously advancing to a second station of the turret wheel assembly.

In yet another form, the method includes the step of verifying that a container is present at the second station of the turret wheel assembly.

In still yet another form, the method further includes the step of advancing the first cup to a third station of the turret wheel assembly and loading a plurality of tobacco sachets into the container.

In a further form, the step of injecting water into a container of tobacco sachets using a source of pressurized water injection is conducted at a fourth and/or fifth station of the turret wheel assembly.

In a yet further form, the step of injecting water into a container of tobacco sachets employs an electronically actuated, hydraulic injector.

In a still yet further form, the step of mechanically applying pressure employs a servo driven linear actuated tamp-and-stir-head to apply mechanical pressure to the plurality of tobacco sachets.

In one form, the step of agitating and stirring the tobacco sachets is effective to lift and stir the plurality of tobacco sachets from the bottom of the container.

In another form, air is injected into the tamp-and-stir-head for cleaning.

In another aspect, provided is an apparatus for distributing moisture and staining the web of a plurality of tobacco sachets. The apparatus includes a turret wheel assembly comprising a rotatable turret wheel having a plurality of cups for receiving containers for tobacco sachets, a sensor for verifying the presence a container within a cup of the rotatable turret wheel, a hydraulic injector for injecting water into a container having a plurality of tobacco sachets, means for tamping tobacco sachets, and means for agitating and stirring the plurality of tobacco sachets to lift and stir tobacco sachets from the bottom of the container.

BRIEF DESCRIPTION OF THE DRAWINGS

The forms disclosed herein are illustrated by way of example, and not by way of limitation, in the figures of the accompanying drawings and in which like reference numerals refer to similar elements and in which.

DETAILED DESCRIPTION

Figure 1:
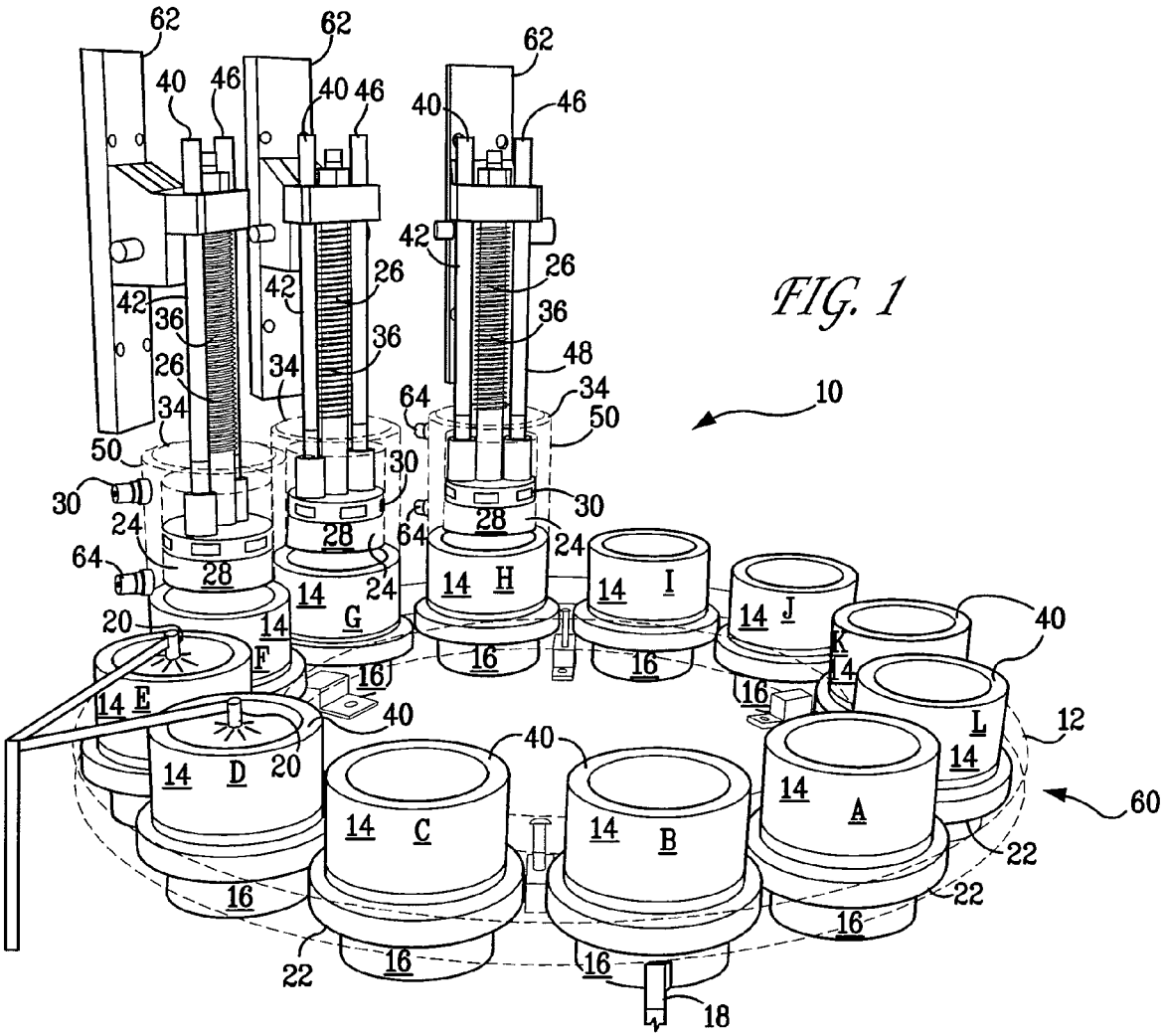
FIG. 1 presents a perspective view of one form of an apparatus for distributing moisture and staining the web of a plurality of tobacco sachets, in accordance herewith.
Figure 2:
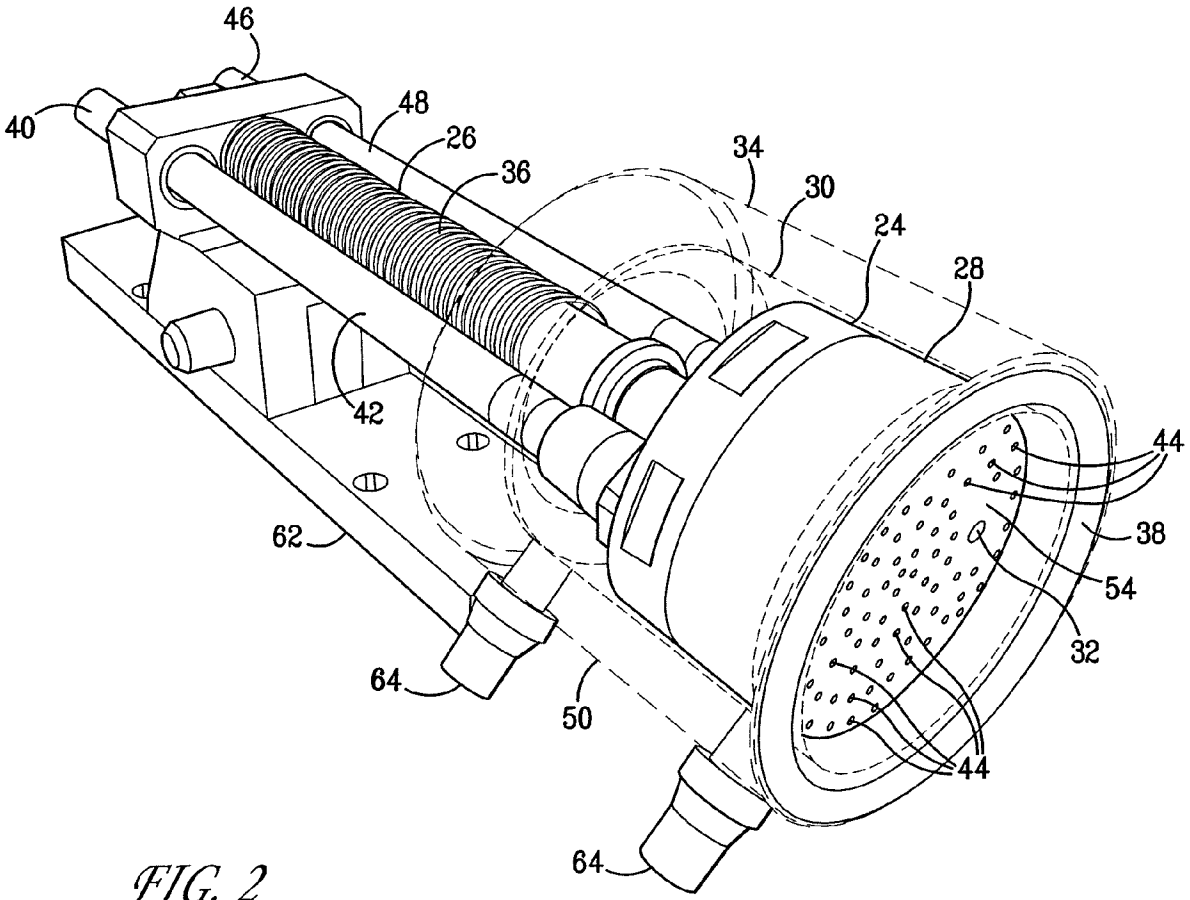
FIG. 2 presents one form of a perspective view of a tamp-and-stir-head assembly, in accordance herewith.
Figure 3:
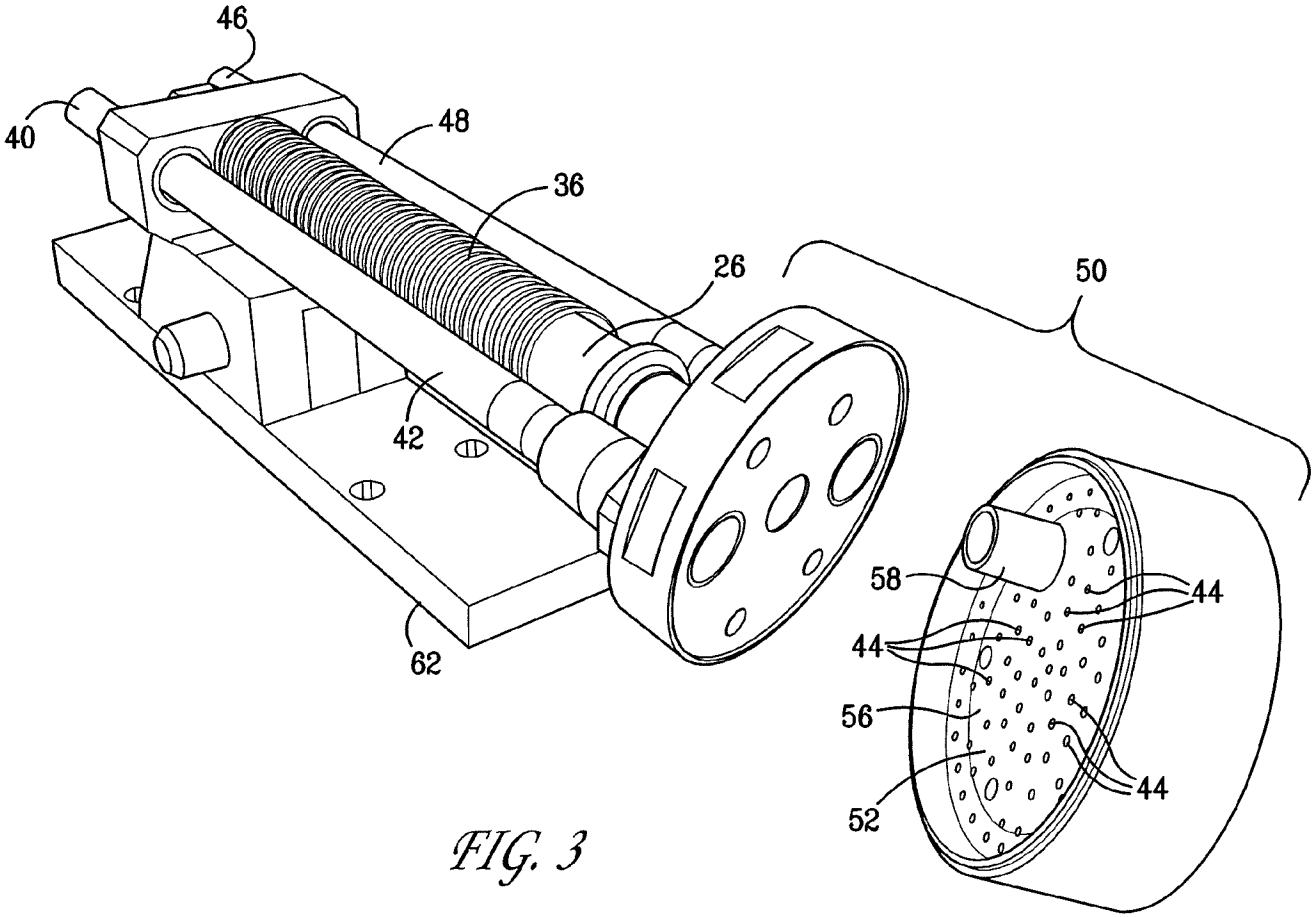
FIG. 3 presents a perspective view of the FIG. 2 tamp-and-stir-head assembly, in a partial disassembled state.

Various aspects will now be described with reference to specific forms selected for purposes of illustration. It will be appreciated that the spirit and scope of the apparatus, system and methods disclosed herein are not limited to the selected forms. Moreover, it is to be noted that the figures provided herein are not drawn to any particular proportion or scale, and that many variations can be made to the illustrated forms. Reference is now made to FIGS. 1-3, wherein like numerals are used to designate like elements throughout.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "'having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

In the production of tobacco sachets, cut or ground tobacco may be employed and can include additives and/or humectants. Examples of suitable types of tobacco materials that may be used include, but are not limited to, flue-cured tobacco, Burley tobacco, Maryland tobacco, Oriental tobacco, rare tobacco, specialty tobacco, reconstituted tobacco, blends thereof and the like. Preferably, the tobacco material is pasteurized. In the alternative, the tobacco material may be fermented.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the like. Genetically modified tobacco may also be used. Additionally, the tobacco material can also include a supplemental amount of vegetable or plant fibers or particles such as particles or shreds of lettuce, cotton, flax, beet fiber, cellulosic fibers, blends thereof and the like.

Humectants can also be added to the tobacco material to help maintain the moisture levels in the tobacco sachets. Examples of humectants that can be used with the tobacco material include glycerol and propylene glycol. It is noted that the humectants can also be provided for a preservative effect, as the water activity of the product can be decreased with inclusion of a humectant, thus reducing opportunity for growth of micro-organisms. Additionally, humectants can be used to provide a higher moisture feel to a drier tobacco component.

The paper, or other suitable web, used in the formation of tobacco sachets can be provided with predetermined levels of basis weight and/or wet strength in order to reduce occurrence of breakage of the web during manufacturing operations, storage and use. For example, webs can be provided with a basis weight of about 5 to about 25 g/m$^2$, such as 5-10, 10-15, 15-20, or 20-25 grams/meters' (g/m$^2$) depending upon the final usage requirements, and/or a wet tensile cross-direction (CD) strength of about 15 to about 75 N/m, such as 15-30, 30-45, 45-60, or 60-75 Newton/meter (N/m), depending upon the final usage requirements, which can be sufficient for maintaining the webs therein. One exemplary material is a tea bag material with a basis weight of about 16.5 g/m$^2$ with a wet tensile CD strength of 68 N/m.

Any suitable equipment may be used to produce the pouched tobacco sachets. For example, a poucher machine sourced from Merz Verpackungsmaschinen GmbH, Lich, Germany, may be employed. Likewise, other systems can be used such as KDF machinery available from Hauni Manufacturing, Hamburg, Germany, or machinery from MediSeal GmbH of Flurstrasse 65, 33758 Schloss-Holte, Germany. See also U.S. Pat. No. 4,703,765, the disclosure of which is hereby incorporated by reference for details of other machinery that can be adapted to manufacture pouches as described herein.

As may be appreciated by those skilled in the art, it is desirable that the web of the tobacco sachets appears to be evenly colored and wetted to the consumer. This uniform color and homogeneous moisture level in each individual package or container is an important characteristic of the product appearance, leading to the perception that it is fresh and new. In part of the packaging process, tobacco sachets are loaded into containers for distribution and sale. It is at this point of loading the sachets into the containers that the apparatus and methods disclosed herein may be integrated into the production process.

Referring now to FIG.1, an apparatus for distributing moisture and staining the paper, or other suitable web, of a plurality of tobacco sachets 10. The apparatus 10 includes a turret wheel assembly 60 including a rotatable turret wheel 12 having a plurality of turret wheel cups 14 for receiving containers 16 used in the packaging of tobacco sachets (not shown). The rotatable turret wheel 12 may have any number of turret wheel cups 14, from 6, 8, 10, 12 or more. In the form depicted in FIG. 1, twelve turret wheel cups 14 are provided and evenly distributed about rotatable turret wheel 12. In such an arrangement, rotatable turret wheel 12 will be stepped or indexed in 30 degree increments to advance from station to station. A servo motor (not shown) may be employed to advance rotatable turret wheel 12 of turret wheel assembly 60.

As will be described in more detail below, apparatus 10 is designed to distribute moisture and stain the paper, or other suitable web, of a tobacco sachet through the use of a process of pressurized water injection, pneumatic agitation/stirring, and mechanically applied pressure.

To better describe the operation of the apparatus 10 and process disclosed herein, a container 16 will be followed from entering to exiting rotatable turret wheel 12, with reference to FIG. 1. At a first station, A, a container 16 is loaded into rotatable turret wheel 12. At each index of rotatable turret wheel 12, a container 16 from the bulk loading system (not shown) is loaded one at a time from underneath turret wheel cup 14, employing the first station, A, only.

At a second station, B, a sensor 18 is provided for verifying the presence of a container 16 within a turret wheel cup 14 of rotatable turret wheel 12. Sensor 18 may be an LED sensor, electromagnetic sensor or any other sensor suitable for this purpose.

At a third station, C, tobacco sachets (not shown) are dropped into the turret wheel cup 14, from a source of tobacco sachets, into a container 16. As the rotatable turret wheel 12 advances, the fourth station, D, and/or, optionally, the fifth station, E, are used to provide pressurized water injection into a turret wheel cup 14, which has the can centered underneath injectors 20.

In one form, injectors 20 may be PLC-controlled, electronically-actuated, hydraulic injectors. The injectors 20 may be equipped with a nozzle to provide a full, cone-shaped spray pattern to evenly distribute a controllable dose of water over the entire exposed container 16 of sachets. Turret wheel cup 14 is provided with a sealing system (not shown) that seals the rim of container 16 (top edge of container 16) to the bottom of the turret wheel cup 22 to prevent leakage.

At a sixth station, F, of turret wheel assembly 60, a means for tamping tobacco sachets 24 is provided. In one form, means for tamping tobacco sachets 24 includes a cylindrical tamping head 28. A servo-driven linear actuator 26 is used to drive tamping head 28 up and down. Servo-driven linear actuator 26 may be mounted to bracket 62. In operation, tamping head 28 is centered over turret wheel cup 14. Servo driven linear actuator 26 drives tamping head 28 down into turret wheel cup 14, applying mechanical pressure (tamping) to randomly oriented tobacco sachets held with a container 16. This mechanical pressure forces the tobacco sachets toward the bottom of container 16 and also forces the water that was injected at stations D and/or E to distribute through the sachets. This mechanically forced distribution of water causes staining to occur, as the water passes through the tobacco and into the paper of the tobacco sachets.

In one form, as the tamping head 28 begins to retract from the turret wheel cup 14, means for agitating and stirring the plurality of tobacco sachets 30 is activated. In the form depicted, tamping head 28 and means for agitating and stirring the plurality of tobacco sachets 30 may be combined into one tamp and stir head assembly 50.

Referring to FIG. 2, means for agitating and stirring the plurality of tobacco sachets 30 includes a pneumatic agitation and stirring jet 32. In one form, pneumatic agitation and stirring jet 32, which may be built into tamping head 28, as shown, injects air from a source of air 46, which flows through tube 48 at a high volume and velocity to lift and stir the mechanically compressed tobacco sachets from the bottom of container 16. Upon completion of the operation, air is evacuated through air evacuation ports 64.

Advantageously, the stirring and agitation has at least four effects on the tobacco sachets: 1) it randomly reorients the tobacco sachets in turret wheel cup 14; 2) it helps distribute moisture through the tobacco sachets; 3) it causes a pounding effect on the sachets, which aids in the paper staining process; and 4) it has a fluffing effect on the tobacco sachets, since the tobacco sachets were flattened by the mechanical pressure during the tamping process. Tamping head 28 also has a spring-loaded cover 34 that seals via sealing ring 38 against the top edge 40 of turret wheel cup 14. This seal serves to maintain cleanliness and also directs the escape air from the stirring jet 32 to be vented in a controlled manner. Sealing ring 38 of on spring-loaded cover is the only part of tamping head 28 to contact turret wheel cup 14.

Still referring to FIG. 2, when tamping head 28 is almost completely retracted from the turret wheel cup 14, stirring jet 32 is turned off and the source of head cleaning air 40 is turned on. Head cleaning air flows through tube 42 and exists into turret wheel cup 14 through a plurality of cleaning air ports 44.

Referring to FIGS. 2 and 3, in one form, tamp and stir head assembly 50 is also equipped with an anti-sticking system 52 that keeps tobacco sachets from sticking, to the face 54 of tamp and stir head assembly 50. This is accomplished by filling an internal-chamber of tamp and stir head assembly 50 with compressed air at a high volume and high pressure. This air then bleeds out through a plurality of small holes 44 in face 54 of tamping head 28 of tamp-and-stir-head assembly 50. As this air bleeds out, any tobacco sachets sticking to face 54 of tamping head 28 of tamp-and-stir-head assembly 50 are ejected back into the turret wheel cup 14. The above-described tamp and-stir-process is completed in turret wheel cup 14 at the sixth station, F, before indexing and advancing turret wheel cup 14 to the seventh station, G.

Of the four effects caused by stirring jet 32, the most important may be the random reorientation of the tobacco sachets in container 16. Randomly reorienting the tobacco sachets in container 16 results in different areas of each tobacco sachet to come in contact with each other, the interior surface of container 16, and face 54 of tamping head 28. The paper stain effect occurs best at the areas or points of high mechanical contact pressure.

At the seventh station, G, there may optionally be a repeat of the same procedure as at the sixth station, F. In that case, another tamp-and-stir-head assembly 50 may optionally be provided. When provided, another servo driven linear actuator 26 is used to drive tamping head 28 up and down. Servo driven linear actuator 26 drives tamping head 28 down into turret wheel cup 14, applying mechanical pressure to randomly oriented tobacco sachets held with a container 16. The mechanical pressure forces the tobacco sachets toward the bottom of container 16 and forces the water to distribute through the sachets. This mechanically forced distribution of water further enhances staining, as the water passes through the tobacco and into the paper of the tobacco sachets. As the tamping head 28 begins to retract from the turret wheel cup 14, means for agitating and stirring the plurality of tobacco sachets 30 is activated. Stirring jet 32, which may be built into tamping head 28, as shown, injects air from a source of air 46, which flows through tube 48 at a high volume and velocity to lift and stir the mechanically compressed tobacco sachets from the bottom of container 16. When tamping head 28 is almost completely retracted from the turret wheel cup 14, stirring jet 32 is turned off and the source of head cleaning air 40 is turned on. Head cleaning air flows through tube 42 and exists into turret wheel cup 14 through a plurality of cleaning air ports 44.

As described above, anti-sticking system 52 keeps tobacco sachets from sticking to the face 54 of tamp and stir head assembly 50 by filling an internal chamber of tamp and stir head assembly 50 with compressed air at a high volume and high pressure. The air then bleeds out through a plurality of small holes 44 in face 54 of tamping head 28 of tamp-and-stir-head assembly 50. As this air bleeds out, any tobacco sachets sticking to face 54 of tamping head 28 of tamp-and-stir-head assembly 50 are ejected back into the turret wheel cup 14. The above-described tamp and-stir-process is completed in turret wheel cup 14 at the seventh station, G, before indexing and advancing turret wheel cup 14 to the eighth station, H. At the seventh station, G, there is an option for an additional stirring jet operation as tamping head 28 is traveling down.

Once again, at eighth station, H, another tamp-and-stir-head assembly 50 may optionally be provided. One objective for the eighth station, H, is to tamp the tobacco sachets down below the top edge of container 16, so that no sachets are trapped between the lid and edge of the container 16. In that case, another tamp-and-stir-head assembly 50 is provided. When provided, another servo driven linear actuator 26 is used to drive tamping head 28 up and down. Servo driven linear actuator 26 drives tamping head 28 down into turret wheel cup 14, applying mechanical pressure to randomly oriented tobacco sachets held with a container 16. The mechanically forced distribution of water further enhances staining, as the water passes through the tobacco and into the paper of the tobacco sachets. As the tamping head 28 begins to retract from the turret wheel cup 14, means for agitating and stirring the plurality of tobacco sachets 30 is activated. Stirring jet 32, which may be built into tamping head 28, as shown, injects air from a source of air 46, which flows through tube 48 at a high volume and velocity to lift and stir the mechanically compressed tobacco sachets from the bottom of container 16. When tamping head 28 is almost completely retracted from the turret wheel cup 14, stirring jet 32 is turned off and the source of head cleaning air 40 is turned on. Head cleaning air flows through tube 42 and exists into turret wheel cup 14 through a plurality of cleaning air ports 44.

As described above, anti-sticking system 52 keeps tobacco sachets from sticking to the face 54 of tamp and stir head assembly 50 by filling an internal chamber of tamp and stir head assembly 50 with compressed air at a high volume and high pressure. The air then bleeds out through a plurality of small holes 44 in face 54 of tamping head 28 of tamp-and-stir-head assembly 50. As this air bleeds out, any tobacco sachets sticking to face 54 of tamping head 28 of tamp-and-stir-head assembly 50 are ejected back into the turret wheel cup 14. The above-described tamp and-stir-process is completed in turret wheel cup 14 at the eighth station, H, before indexing and advancing turret wheel cup 14 to the ninth station, I. At the eighth station, H, there is an option for an additional stirring jet operation as tamping head 28 is traveling down.

The ninth and tenth stations, I and J, can be used for a variety of optional operations, including a container inspection, or the like. In one form, no operation is performed. Containers 16 may exit rotatable turret wheel 12 at the eleventh station. Optionally, containers 16 may exit rotatable turret wheel 12 at the twelfth station, K. In one form, no operation may be performed at the twelfth station, K.

In one form, additional tamp and stir head assemblies 50 are employed at the ninth and tenth stations, I and J, if additional darkening of the sachet paper is desired.

As may be appreciated by those skilled in the art, sachet paper that stains and absorbs moisture easily does not require the apparatus and methods disclosed herein to improve the aesthetics of the sachets. However, if a sachet paper is desired due to its texture or other characteristics, but does not absorb moisture or stain easily, the apparatus and methods disclosed herein will permit this type of paper to be used.

When sachet papers that stain and absorb moisture easily are used, moisture is added after the sachets are pressed into the bottom of the packaging container. These containers, once the lid and side label have been applied, however, are required to sit for a number of weeks prior to shipment for the moisture to equilibrate and the paper to stain naturally. The apparatus and methods disclosed herein eliminate the need to wait for the moisture equilibration and paper staining.

Although the preferred form is described with reference to sachets filled with tobacco, the teachings herein may be applied in the context of other types of sachets such as those filled with food materials, spices, pharmaceuticals and any other filler material, including tea.

While the present inventions have been described in connection with a number of exemplary forms, and implementations, the present inventions are not so limited, but rather cover various modifications, and equivalent arrangements, which fall within the purview of the present claims.

What is claimed:

1. A method of distributing moisture and staining a plurality of tobacco sachets filled with tabacco, each sachet comprising a web, the method comprising:

(a) injecting water from a source of pressurized water into a container having a plurality of tobacco sachets;

(b) mechanically applying pressure to the plurality of tobacco sachets; and (c) agitating and stirring the tobacco sachets using a pneumatic means for agitation and stirring, wherein water is distributed through each of the plurality of tobacco sachets to stain the web thereof as the water passes through the tobacco and into the web.

2. The method of claim 1, further comprising the step of loading a container for tobacco sachets into a first cup of a rotatable turret wheel, said container loading step conducted at a first station of a turret wheel assembly.

3. The method of claim 2, further comprising the step of advancing the turret wheel to place a second cup at the first station of the turret wheel assembly and loading a second container into the second cup, the first cup simultaneously advancing to a second station of the turret wheel assembly.

4. The method of claim 3, further comprising the step of verifying that a container is present at the second station of the turret wheel assembly.

5. The method of claim 3, further comprising the step of advancing the first cup to the third station of the turret wheel assembly and loading a plurality of tobacco sachets into the container.

6. The method of claim 5, wherein said step of injecting water into a container of tobacco sachets using a source of pressurized water injection is conducted at a fourth and/or fifth station of the turret wheel assembly.

7. The method of claim 6, wherein said step of injecting water into a container of tobacco sachets employs an electronically actuated, hydraulic injector.

8. The method of claim 7, further comprising the step of advancing the first cup to a sixth station of the turret wheel assembly prior to conducting step (b).

9. The method of claim 8, wherein said step of mechanically applying pressure employs a servo driven linear actuated tamp-and-stir-head to apply mechanical pressure to the plurality of tobacco sachets.

10. The method of claim 9, wherein said step of agitating and stirring the tobacco sachets is effective to lift and stir the plurality of tobacco sachets from the bottom of the container.

11. The method of claim 10, further comprising the step of injecting air to clean the tamp-and-stir-head.

12. The method of claim 10, further comprising the step of advancing the first container to a seventh station and repeating steps (b) and (c).

13. The method of claim 10, further comprising the step of advancing the first container to a seventh station and repeating step (c).

14. The method of claim 10, further comprising the step of advancing the first cup to a further station and removing the container.

15. An apparatus for distributing moisture and staining a plurality of tobacco sachets, each sachet comprising a web, the apparatus comprising:

(a) a turret wheel assembly comprising a rotatable turret wheel having a plurality of turret wheel cups for receiving containers for tobacco sachets;

(b) a sensor for verifying the presence of a container within a cup of said rotatable turret wheel;

(c) a hydraulic injector for injecting water into a container having a plurality of tobacco sachets;

(d) at least one servo driven linear actuated tamping head for tamping tobacco sachets; and (e) at least one pneumatic agitation and stirring jet for agitating and stirring the plurality of tobacco sachets to lift and stir tobacco sachets from the bottom of the container.

16. The apparatus of claim 15, wherein said means for tamping tobacco sachets includes at least one servo driven linear actuated tamping head to apply mechanical pressure to the plurality of tobacco sachets.

17. The apparatus of claim 16, wherein said means for agitating and stirring the plurality of tobacco sachets includes a pneumatic agitation and stirring jet.

18. The apparatus of claim 17, wherein said pneumatic agitation and stirring jet is built into said tamping head and injects air from a source of air.

19. The apparatus of claim 18, wherein said tamping head and said means for agitating and stirring the plurality of tobacco sachets are combined into a tamp and stir head assembly.

20. The apparatus of claim 19, further comprising a plurality of tamp and stir head assemblies.

21. The apparatus of claim 20, further comprising a plurality of hydraulic injectors.

22. The apparatus of claim 20, further comprising an anti-sticking system for preventing tobacco sachets from sticking to a face of said tamp and stir head assemblies.

23. The apparatus of claim 22, wherein said anti-sticking system includes an internal chamber of tamp and stir head assembly and fills said internal chamber with compressed air at a high volume and high pressure.

24. The apparatus of claim 23, wherein said anti-sticking system includes a plurality of holes in said face of said tamping head of said tamp-and-stir-head assembly.

25. The apparatus of claim 15, wherein said rotatable turret wheel includes from 6 to 12 turret wheel cups.

26. The apparatus of claim 25, wherein said rotatable turret wheel includes 12 turret wheel cups.

27. A method of distributing moisture and staining a plurality of sachets, each sachet comprising a web and a filler material, the method comprising:

(a) injecting water from a source of pressurized water into a container having a plurality of sachets;

(b) mechanically applying pressure to the plurality sachets; and (c) agitating and stirring the sachets using a pneumatic means for agitation and stirring, wherein water is distributed through the plurality of sachets to stain the web thereof as the water passes through the filler material and into the web.

28. An apparatus for distributing moisture and staining a plurality of sachets, each sachet comprising a web and a filler material, the apparatus comprising:

(a) a turret wheel assembly comprising a rotatable turret wheel having a plurality of cups for receiving containers for sachets;

(b) a sensor for verifying the presence a container within a cup of said rotatable turret wheel;

(c) a hydraulic injector for injecting water into a container having a plurality of sachets;

(d) at least one servo driven linear actuated tamping head for tamping sachets; and (e) at least one pneumatic agitation and stirring jet for agitating and stirring the plurality of sachets to lift and stir sachets from the bottom of the container.

29. The apparatus of claim 15, wherein said hydraulic injector is electronically actuated.

* * * * *